United States Patent [19]

Ellegast

[11] 3,939,639

[45] Feb. 24, 1976

[54] SPIN STRETCHING AND SPIN STRETCH TEXTURING OF MULTIFILAMENT YARNS

[75] Inventor: Konrad Ellegast, Leichlingen, Germany

[73] Assignee: Bayer Aktiengesellschaft, Leverkusen, Germany

[22] Filed: June 5, 1974

[21] Appl. No.: 476,460

[30] Foreign Application Priority Data

June 5, 1973 Germany ..... 2328499

[52] U.S. Cl. ..... 57/157 R; 57/106

[51] Int. Cl.[2] ..... D02J 1/22

[58] Field of Search ..... 57/1 R, 34 R, 34 HS, 52, 57/54, 58.83, 106, 156, 156, 157 R, 157 TS, 157 MS, 36, 157 S; 425/66, DIG. 17, DIG. 40; 264/210 F

[56] References Cited

UNITED STATES PATENTS

| | | | |
|---|---|---|---|
| 2,786,737 | 3/1957 | Hawtin et al. | 57/157 R X |
| 3,012,393 | 12/1961 | Schuttleworth et al. | 57/106 X |
| 3,161,010 | 12/1964 | Solteri et al. | 57/157 R X |
| 3,346,684 | 10/1967 | Gosden | 264/210 F X |
| 3,444,681 | 5/1969 | Reese | 57/157 R X |
| 3,448,571 | 6/1969 | Tsuzuki | 57/36 |
| 3,469,385 | 9/1969 | Tsuzuki | 57/34 R |
| 3,526,569 | 9/1970 | Chopra et al. | 264/210 F X |
| 3,555,808 | 1/1971 | Gutmann | 264/210 F |
| 3,605,396 | 9/1971 | Guignard et al. | 57/106 |
| 3,791,121 | 2/1974 | Ernst | 57/157 R X |
| 3,819,099 | 6/1974 | Bierenfeld | 57/34 R X |

*Primary Examiner*—Donald E. Watkins
*Attorney, Agent, or Firm*—Plumley and Tyner

[57] ABSTRACT

This invention relates to a process for the continuous manufacture of smooth or textured multifilament yarns from synthetic thermoplastic high molecular weight polymers by the spin stretching or spin stretch texturing processes, wherein the unstretched multifilament yarn is passed from the spinning machine to the stretching or stretch texturing machine through tubes made of metal, plastics or glass, although other materials may also be used, e.g. ceramics.

7 Claims, 1 Drawing Figure

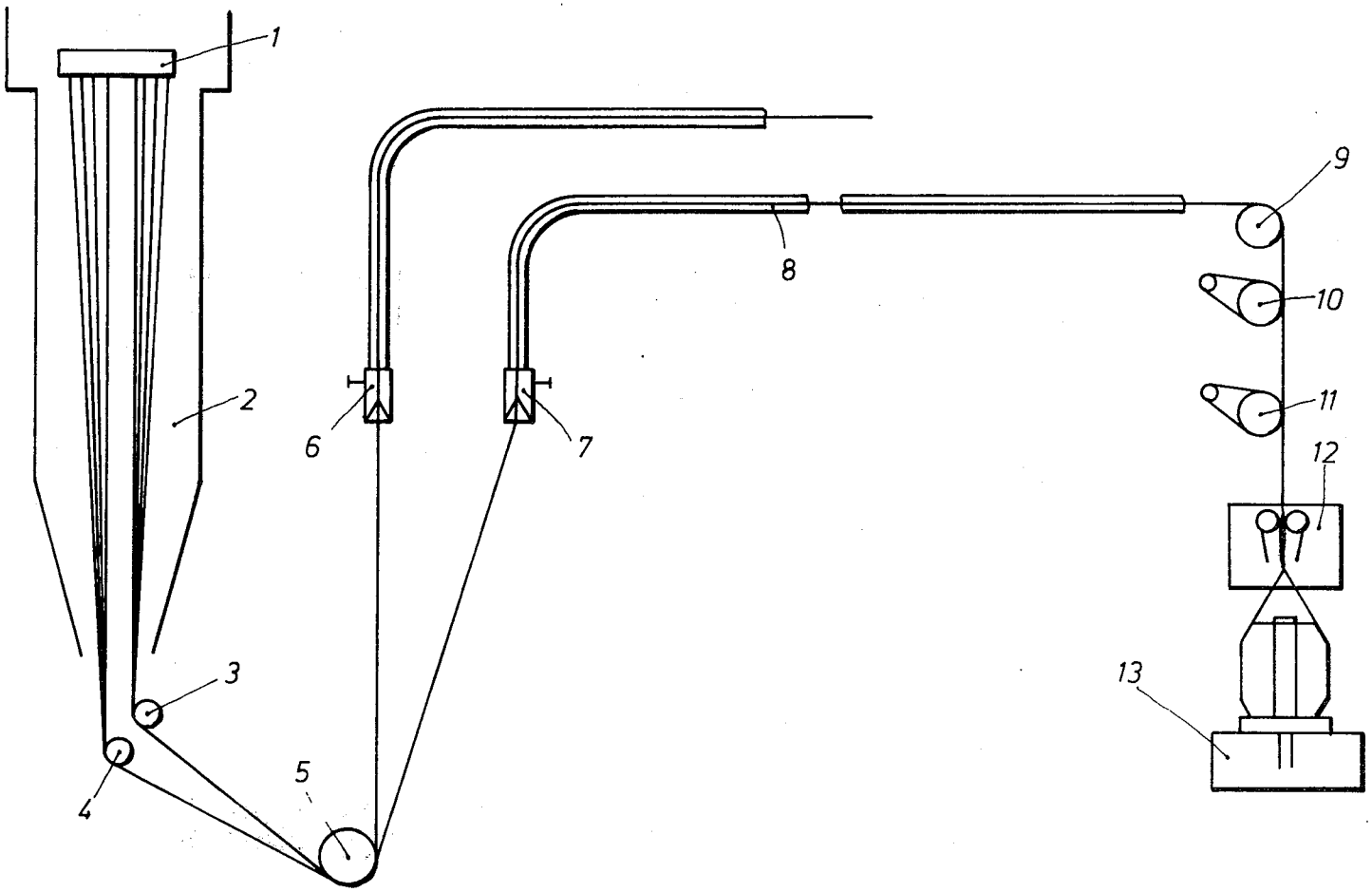
1
2
3
4
5
6
7
8
9
10
11
12
13

SPIN STRETCHING AND SPIN STRETCH TEXTURING OF MULTIFILAMENT YARNS

This invention relates to a process for the continuous production of smooth or textured multifilament yarns from synthetic thermoplastic high molecular weight polymers by the spin stretching or the spin stretch texturing processes.

For economical reasons most known rapid spinning processes are carried out at spinning velocities of from 500 to 1,000 m/min and at stretching velocities 3 to 4 times higher.

These rapid processes are technically very costly and the risk of accidents to the operators also increases with increasing working speed. Another disadvantage of these processes is the short residence time between the spinning die and the stretching zone, which necessitates correspondingly vigorous cooling conditions which may, especially in the case of polyamide 6, cause freezing of the unstable $\gamma$-modification which has a different dye absorption level than the more stable $\alpha$-modification. This may result in streaky dyeing, for example in the case of piece dyed carpets.

Consequently it has been recommended to employ low spinning velocities, (200 ml min) and high relative humidity, (70%) for spin stretching process, (see German Auslegesschrift No. 1,278,683), and, in addition, the multifilament yarn is deflected over pairs of rollers in order to increase the residence time between the spinning die and the stretching zone to from 10 to 60 seconds. Although this process obviates the disadvantages described above, it is relatively uneconomical owing to the low output and the amount of attendance required on the part of the operators.

In another process in which low spinning draw-off rates are employed, (from 150 to 35 m/min.), the spin draw-off roller serves as both stretching and delivery roller. Because of the short residence time between the spinning die and stretching zone the risk of fluctuations in the dye affinity is great.

It is an object of the present invention to obviate the above mentioned disadvantages.

It has been found that the above described disadvantages may be overcome by reducing the draw-off rates of the spinning threads by using multiple dies and arranging for a residence time of more than 1 second between the die and the stretching zone.

The invention therefore relates to a process for the continuous manufacture of smooth or textured multifilament yarns from synthetic thermoplastic high molecular weight polymers by the spin stretching or spin stretch texturing processes, wherein the unstretched multifilament yarn is passed from the spinning machine to the stretching or stretch texturing machine through tubes made of metal, plastics or glass, although other materials may also be used, e.g. ceramics.

The invention may be better understood by reference to the drawing in which: 1 represents a double die; from which emerge two filaments per shaft 2; 3 and 4 represent spin finish rollers; 5 represents a roller; 6 and 7 represent air suction nozzles; a tube 8; a conveyor roller 9; 10 and 11 represent rollers; 12 represents a well known stuffer box crimping device; and 13 a spooling device.

The transport of the multifilament yarns from the spinning shaft to the stretching or stretch texturing machine must therefore be regarded as another important step in the process of the present invention. The yarns are transported through long tubes of metal, plastics or other materials, the dressed unstretched yarn being blown through a connecting tube by means of a suction nozzle. The air nozzle is kept in operation only until the multi-filament yarn has been gripped by the delivery roller of the machine to which it is being transported. The advantage of this method is that the increase in the transport path results in an increase in the residence time which is sufficient to form the stable $\alpha$-crystal modification. In the present process the residence time between spinning die and stretching zone is more than 1 second, preferably from 5 to 30 seconds.

The transport through long tubes, having diameters below 30mm, preferably from 15 to 20mm is preferable to deflection over several rollers because the number od deflections then required is very small and consequently the tension exerted on the yarn may be kept below the limit at which the yarn begins to stretch. The tension on the thread along the path of transport is preferably less than 2 p/den. An important cost saving is achieved by the fact that the machines, which are spaced far apart for multistage processes, may now be combined very simply for a direct process by connecting them with transport tubes.

The machines may be left at their original site so that there is a considerable saving in the costs which would otherwise be required for new constructions or changes in location.

The transport velocity for multifilament yarns is from 70 to 500, preferably 150 to 300 m/min.

The present method may easily be employed without any alternations to conventional spinning machines, simply by installing the tubes required for transporting the spinning material in the appropriate part of the machine. When these tubes are not in use, e.g. if any technical faults occur in the subsequent processes, the yarn may be spooled in the conventional manner employed previously. It is also possible to employ both methods simultaneously in which case one multifilament yarn is spooled by the conventional method while the other is passed through the transport tube directly to the stretch texturing or stretching machines. This may be important, for example in the case of technical faults in individual parts of the stretching or stretch texturing machinery.

The stretch texturing processes to which the present invention may be applied are in principle any conventional processes of this kind, e.g. blow jet crimping, stuffer box crimping and false twist texturing.

In the present process, the spinning output per shaft is maintained or even increased although at the same time the spinning draw-off rates are reduced. This is achieved by using multiple spinning dies. In these dies for multifilament yarns, a separating zone is left between the individual groups of threads so that the group may already be separated within the spinning shaft. If double dies are used, e.g. dies with two groups of 63 apertures, the drawoff rate is halved and in the case of triple dies it is reduced to one third.

This process is in principle suitable for any polymers which are capable of being spun, although it is particularly suitable for polyamides and more particularly multifilament yarns of polyamides with a total titre of over 500 dtex. It has been particularly difficult in the past, when employing a direct method of processing polyamides, to maintain a uniform level of dyeing because of the changes in the polyamide modifications mentioned above. For this reason, the air jet in the process according to the invention is adjusted, e.g. to a relative humidity of from 60 to 80% at a temperature of from 20° to 26°C. These atmospheric conditions, which are unsuitable for a spooling process, are advantageous for the direct process and are, moreover, less expensive.

When processing multifilament yarns with high titres as in Example 2, a considerable increase in output may be achieved even within the velocity limits indicated.

The present process may be employed both for producing smooth stretched yarns and for producing stretch textured yarns. There is little risk of premature stretching of yarns with titres above 500 dtex. For the sake of convenience to the operators, the subdivision of a multifilament yarn into several individual yarns is preferably carried out in the spinning shaft. However it may also be carried out after the transport through the tube. This is of particular interest for low denier yarns. In this way, a plurality of stretching or stretch texturing machines may be supplied from a single spinning shaft.

The following Examples are to further illustrate the invention without limiting it.

EXAMPLE 1

In a spinning machine which is directly connected to a polymide-6 polymerisation plant, filament yarns with a titre of 4,000 dtex each are spun two per shaft, 2, from double dies, 1, which each have 2 × 63 apertures. This corresponds to a spinning output of 13.2 kg per shaft per hour if the draw-off rate is 275 m/min. When the yarn is spread out, half the yarn, (i.e. 63 filaments), leaving the spinning die is passed over spin finish rollers 3 and 4, where the spin finish required for subsequent processes is applied. The sliver is then passed over roller 5 which moves at the draw-off rate, (275 m 1 min), to an air suction nozzle 6, which draws the cable to it by suction and passes it through a tube 8, approximately 20m in length to the texturing machine which is situated some distance away. In the texturing machine, the yarn is taken over by a second, movable suction nozzle and passed over the conveyor roller 9, to be introduced into the stretch texturing machine. This conveyor roller is adjusted to a circumferential velocity of 278 m/min to produce the thread tension necessary to ensure that the thread will be smoothly pulled through the transport tube.

As soon as the sliver has been gripped by the conveyor roller of the stretch texturing machine, the air nozzle 6, of the spinning shaft is switched off by the operator of the stretch texturing machine. This air nozzle may be operated from both machines by a double throw switch which controls an electromagnetic valve. Signals, e.g. lights, at both operating stations indicate when the conveyor nozzle is in operation and thus facilitate the spreading process.

The second spinning sliver may either be conveyed directly into another delivery tube or it may be spooled and then worked-up separately.

For the same spinning shaft output, the draw-off rate when using a 63 aperture die would have to be 550m/min to obtained a yarn of the same titre. The residence time of the spinning cable between the nozzle and the delivery roller of the texturing machine is approximately 6 seconds in the given Example.

EXAMPLE 2

Two filament yarns with a spinning titre of 8,000 dtex each are spun from a double spinning die with 2 × 126 apertures. The draw-off rate necessary for the spinning output of 13.2 kg/hour indicated in Example 1 is, in the case, 137.5 m/min. The residence time along the same transport paths is incresed correspondingly to approximately 12 seconds.

The cable which has been spun at this velocity is stretched in the ratio of 1:3.8 and introduced into a crimping apparatus, (delivery rate 520 m/min), immediately behind the stretching zone. The textured cable is immediately spooled after it has been crimped.

If the same spinning and texturing velocities are used as in Example 1, the output is doubled.

I claim:

1. Process for the continuous production of multifilament yarns from synthetic thermoplastic high molecular weight polymers wherein unstretched multifilament yarn is passed from a spinning zone to a stretching zone through protective tubes.

2. Process according to claim 1, wherein the multifilament yarn is passed through said tubes by means of an air nozzle, and, when it has passed through the stretching zone, it is pulled and transported by a delivery mechanism while the air nozzle is switched off.

3. Process according to claim 1, wherein the multifilament yarn is passed at velocities of from 70 to 500 m/min, and at thread tensions below 2 p/den through protective tubes, the internal diameters of which are less than 30 mm.

4. Process according to claim 1, wherein the residence time of the multifilament yarn along the transport path, which is determined by the spinning velocity and the transport path between the spinning die and the stretching zone is at least one second.

5. Process according to claim 1, wherein multiple spinning dies are used to slow down the spinning velocity and increase the spinning output in the spin stretching process, and the multifilament yarn is separated into several individual yarns after transport through the tube.

6. Process according to claim 1, wherein the total titre of the multifilament yarns is from 500 to 10,000 dtex.

7. Process according to claim 1, wherein the multifilament yarn used is a polyamide-6 multifilament yarn.

* * * * *